US005319670A

United States Patent [19]

Fox

[11] Patent Number: 5,319,670

[45] Date of Patent: Jun. 7, 1994

[54] VELOCITY DAMPER FOR ELECTROMAGNETICALLY LEVITATED MATERIALS

[75] Inventor: Richard J. Fox, Oak Ridge, Tenn.

[73] Assignee: The United States of America as represented by the United States Department of Energy, Washington, D.C.

[21] Appl. No.: 918,095

[22] Filed: Jul. 24, 1992

[51] Int. Cl.[5] ..... H05B 6/32

[52] U.S. Cl. ..... 373/138; 219/648

[58] Field of Search ..... 373/138, 139, 141, 147; 219/7.5, 10.43, 10.75, 10.79

[56] References Cited

U.S. PATENT DOCUMENTS

| | | | |
|---|---|---|---|
| 2,686,864 | 8/1954 | Wroughton et al. | 373/138 |
| 2,957,064 | 10/1960 | Comenetz | 373/138 |
| 3,310,384 | 3/1967 | Keller | 373/139 |
| 3,685,973 | 8/1972 | Keller et al. | 373/139 |
| 3,705,789 | 12/1972 | Keller | 373/139 |
| 4,578,552 | 3/1986 | Mortimer | 219/10.41 |
| 4,905,756 | 3/1990 | Lari et al. | 164/467 |
| 4,979,182 | 12/1990 | Lohoefer | 373/138 |
| 4,993,043 | 2/1991 | Lohoefer | 373/138 |
| 5,003,551 | 3/1991 | Mortimer | 373/139 |
| 5,033,948 | 7/1991 | El-Kaddah et al. | 425/8 |
| 5,150,272 | 9/1992 | Darley et al. | 361/144 |
| 5,155,651 | 10/1992 | Yoda et al. | 361/144 |

*Primary Examiner*—Bruce A. Reynolds
*Assistant Examiner*—Tu Hoang
*Attorney, Agent, or Firm*—David E. Breeden; Stephen D. Hamel; William R. Moser

[57] ABSTRACT

A system for damping oscillatory and spinning motions induced in an electromagnetically levitated material. Two opposed field magnets are located orthogonally to the existing levitation coils for providing a DC quadrupole field (cusp field) around the material. The material used for generating the DC quadrupole field must be nonconducting to avoid eddy-current heating and of low magnetic permeability to avoid distorting the induction fields providing the levitation.

6 Claims, 1 Drawing Sheet

VELOCITY DAMPER FOR ELECTROMAGNETICALLY LEVITATED MATERIALS

BACKGROUND OF THE INVENTION

This invention relates generally to electromagnetic levitation systems and more specifically to apparatus for controlling induced movement of an electromagnetically levitated material. The United States Government has rights in this invention pursuant to Contract No. DE-AC05-840R21400 with Martin Marietta Energy Systems, Inc., awarded by the U.S. Department of Energy.

Heretofore, apparatus and devices have been provided for containerless processes which have been classified into two groups, ground base and space flight type processes. Ground based processes for high temperature metals and alloys in a low gravity containerless environment have been limited mainly to drop tubes. A drop tube is a long vertical tube in which molten samples are allowed to free fall through vacuum or a cooling gas to enhance cooling rates. Drop tubes are for only short free fall and processing times on the order of less than five seconds.

Previous and current methods for containerlessly processing samples during a space flight may be grouped into two categories, acoustic levitators and electromagnetic levitators. Acoustic levitators position the sample by use of resonant sound waves. To heat and melt a sample auxiliary heating must be used. Currently, all auxiliary heating is by laser or radiant energy.

Electromagnetic levitators operate by passing a high frequency oscillating current through a previously formed coil. An electromagnetic field is then set up inside the coil which can levitate a metallic sample. The electromagnetic levitator may be used to heat and position a sample. The sample is cooled by controlling the coil current or by passing a cooling gas through the coil and around the sample. To facilitate heating, an optional electron beam may be used with an electromagnetic levitator.

Levitation of metallic samples by electromagnetic induction provides an effective means for containerless melting of many chemically reactive metals, e.g., Ti, Zr, Nb. Since no crucible is required, and generally the processing can be done in vacuum, melting processes can be carried out without contamination of the sample.

One of the problems encountered with electromagnetic levitation, particularly in a vacuum, is that the levitating magnetic field provides no mechanical damping of the sample. The sample often oscillates about its equilibrium position, and may even spin. Such oscillations can bring a sample into contact with the coils used to generate the levitation field, thus damaging the coils or contaminating the sample.

It is well known that mechanical oscillations can be suppressed by the proper application of a DC magnetic dipole field (velocity damping). The magnetic damper on an analytical balance is an example. As the damper vane moves through a non-uniform field, current loops are induced in the vane and the energy of oscillation of the balance beam is dissipated as heat in the vane. However, this approach demands a nonuniform field; uniform fields are ineffective.

Any attempt to apply velocity damping in its usual form to an electromagnetically levitated sample must consider that the sample is surrounded by the radio frequency (RF) levitator coils. It is therefore not possible to get a dipole damper magnet close enough to the sample to generate a nonuniform field in the sample.

Therefore, it will be apparent that there is a need for a means of applying magnetic damping to a material which is electromagnetically levitated.

SUMMARY OF THE INVENTION

In view of the above need, it is an object of this invention to provide a means for magnetic damping of electromagnetically levitated metallic samples.

Further, it is an object of this invention to provide a means for magnetic damping of electromagnetically levitated metallic samples through the application of DC magnetic fields.

Yet another object of this invention is to provide a DC magnetic based system for magnetically damping both oscillatory motion and spinning motion of an electromagnetically levitated metallic samples.

Briefly, this invention is a passive permanent-magnet quadrupole velocity-damper for electromagnetically levitated metallic samples. In an electromagnetic levitation system for metallic materials including a pair of AC magnetic induction coils aligned about a common axis and operated in the radio frequency (RF) range between which the material is inductively levitated at a point along the common axis thereof, the passive damping system according to the present invention comprises a pair of permanent magnets disposed in opposing field alignment orthogonal to the axis of the levitation coil to form a DC magnetic quadrupole field (cusp field) at the equilibrium position of levitation of the material so that any motion of the material is magnetically damped.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawing FIG. 1, which is incorporated in and forms a part of this specification, is a schematic diagram illustrating a velocity damper for damping oscillations of an electromagnetically levitated sample according to the present invention and, together with the description, serves to explain the principles of the invention.

DETAILED DESCRIPTION

Figure 1:
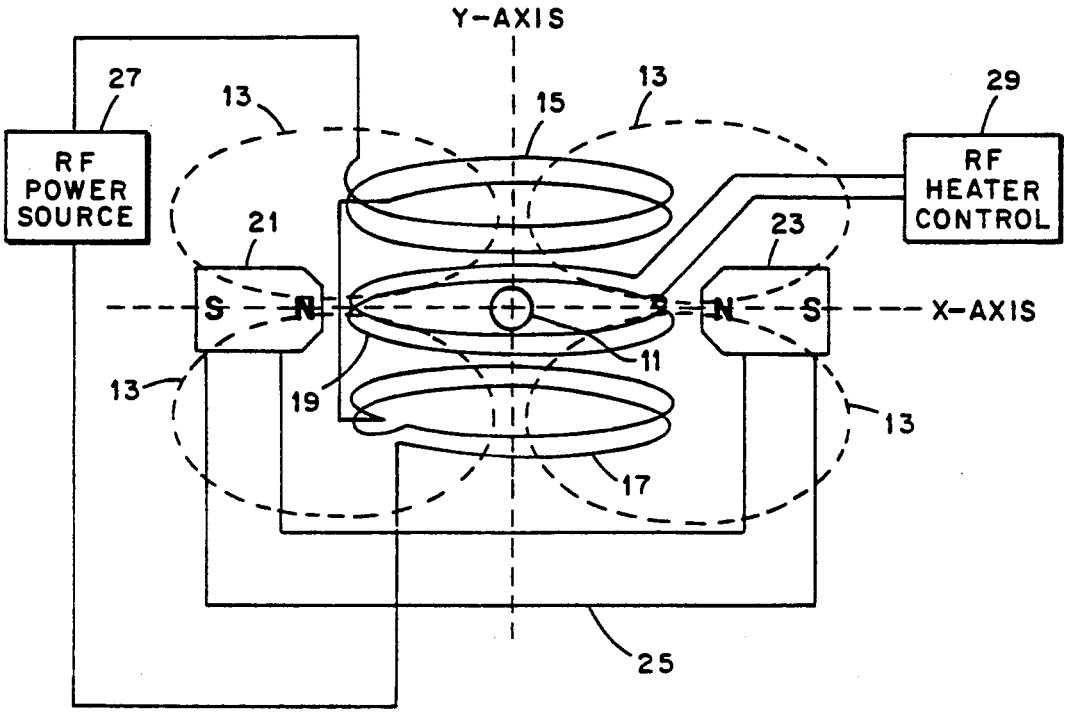

Referring now to FIG. 1, there is shown a velocity damper for an electromagnetic levitation device in which a molten metal sample 11 is levitated. The levitation of the sample 11 is provided by means of an RF quadrupole magnetic field illustrated by the four dashed field lines 13 and produced by a pair of RF levitation coils 15 and 17 disposed along a common axis in a spaced apart relationship. The common axis will be designated herein as the Y-axis for reference purposes. The coils 15 and 17 are connected in series opposition to an RF power source 27 which supplies the selected RF current to the coils to maintain the levitation field for the sample 11.

In this arrangement, the sample 11 may be inductively heated by means of an induction heating coil 19 disposed along the Y-axis midway between the pair of levitation coils 15 and 17, which is the equilibrium position of the sample. The heating coil 19 provides the induction heating for the sample and is separately controlled to maintain the desired sample temperature by means of a separate RF heater control 29 connected to the coil 19 to supply RF power thereto. The heating coil is connected as a dipole coil and operated at a frequency substantially different from that of the excitation frequency for the levitation coils so that it produces a minimum influence on the positioning of the sample 11. Typically, for a 5 mm diameter sample, the levitation coils each consist of two turns of copper tubing wound to form an 8 mm ID coil and are operated at a frequency of 300 kHz. The heating coils are of the same, or slightly larger, inner diameter and are operated at a frequency of 600 kHz.

The radio-frequency power to each coil set may be supplied through a separate coaxial current transformer (not shown). The transformers and the coils 15, 17 and 19 may be water cooled by passing the coolant through the transformers and the tubing forming the coils.

In accordance with the present invention, a pair of opposed permanent magnets 21 and 23 are disposed along an X-axis which is orthogonal to the Y-axis and passes through the equilibrium position of the sample 11. The permanent magnets are held in position by means of a support frame 25. The magnets 21 and 23 are preferably cylindrical and disposed apart a distance slightly greater than the outer diameter of the heating coil 19. The magnets 21 and 23 are provided with tapered opposing pole faces 27 and 29, respectively, to produce a DC quadrupole field which is also represented by the field lines 13. The tapered pole faces aid in increasing the field gradient of the cusped DC magnetic field adjacent the sample and thus improved damping. It will be understood however that the axes of symmetry for the RF and the DC quadrupole fields are orthogonal.

The quadrupole field provided by the magnets 21 and 23 produces a cusped DC magnetic field which has a field gradient,(slope) which is at or near maximum at the midpoint of the field. Thus, samples that are relatively small compared to the pole spacing of the magnets can be effectively damped.

Due to the high frequency of the levitation field, the permanent magnets must be nonmetallic to avoid eddy-current heating. Further, the magnets must not alter the high frequency levitation field, which eliminates the use of high permeability magnetic materials. It has been discovered that the foregoing requirements can be met by fabricating the magnets 21 and 23 of oriented barium ferrite having an energy density of 3.4 megagauss-oersted. This material is electrically insulating and has a permeability near unity.

Damping experiments performed on levitated 5 mm hollow aluminum spheres in air indicated damping rates nearly an order of magnitude greater than air damping alone. Further experiments have shown that sample spin is also damped, even in vacuum environments.

Thus, it will be seen that a magnetic velocity damper has been provided for use in damping mechanical motion of an electromagnetically levitated material. Although the invention has been described by means of a description of a preferred embodiment of the present invention, those skilled in the art will recognize that various modifications and changes may be made therein without departing from the spirit and scope of the invention as set forth in the following claims attached to and forming a part of this specification.

I claim:

1. In combination with an electromagnetic levitation system for levitating a metallic material including an AC magnetic induction coil means operated at a radio frequency range for generating a magnetic levitation field region about a first axis within which said material is inductively levitated at a point of equilibrium along said first axis, a passive damping system comprising a pair of permanent magnets disposed in opposing field alignment along a second axis orthogonal to said first axis to form a cusped DC magnetic quadrupole field at said point of equilibrium of said material so that motion of said material within said levitation field region is magnetically damped thereby.

2. In combination with an electromagnetic levitation system for levitating a metallic sample including a pair of AC magnetic induction coils aligned about a common axis and operated within a radio frequency range at which said sample is inductively levitated at a point of equilibrium along the common axis thereof, a passive damping system comprising a pair of permanent magnets disposed in opposing field alignment orthogonal to said common axis of said induction coils to form a cusped DC magnetic quadrupole field at said point of equilibrium of the levitated sample so that motion of said sample about said point of equilibrium is magnetically damped thereby.

3. The combination as set forth in claim 2 wherein said permanent magnets are formed of a non-metallic material of low permeability.

4. The combination as set forth in claim 3 wherein said permanent magnets are formed of barium ferrite.

5. The device as set forth in claim 4 wherein said pair of permanent magnets includes opposing magnetic surfaces which are spaced apart and inwardly tapered.

6. The device as set forth in claim 2 wherein said sample is a molten metal and wherein said levitation system further includes a heating means for heating said sample.

* * * * *